US006327819B1

(12) United States Patent
Kurose

(10) Patent No.: US 6,327,819 B1
(45) Date of Patent: Dec. 11, 2001

(54) FACE GRATING

(75) Inventor: Kazutoshi Kurose, Yokohama (JP)

(73) Assignee: Goumei Kaisha Kurose Shouten (JP)

( * ) Notice: Subject to any disclaimer, the term of this patent is extended or adjusted under 35 U.S.C. 154(b) by 0 days.

(21) Appl. No.: 09/610,978

(22) Filed: Jul. 6, 2000

(30) Foreign Application Priority Data

Jan. 26, 2000 (JP) ..... 12-017701

(51) Int. Cl.[7] ..... E06B 3/68

(52) U.S. Cl. ..... 49/50; 52/202; 52/668

(58) Field of Search ..... 49/50, 57, 61, 49/141; 52/202, 203, 665, 666, 667, 668

(56) References Cited

U.S. PATENT DOCUMENTS 1,789,280 * 1/1931 Armstrong ..... 52/667 X
3,748,814 * 7/1973 Cribben ..... 52/668
3,927,950 * 12/1975 Herrmann et al. ..... 52/668 X
4,907,389 * 3/1990 Pettit ..... 52/668

* cited by examiner

*Primary Examiner*—Jerry Redman
(74) *Attorney, Agent, or Firm*—Lorusso & Loud

(57) ABSTRACT

The present invention relates to a face grating including bearer members having a large number of holding projections formed at predetermined intervals along their longitudinal dimension. The bearer members are fixed to the exterior wall above and below or to the left and right of a building window with the holding projections facing outwardly. A plurality of elastic panels are formed in a substantially channel-like shape with curved portions at their opposing longitudinal edges and are mounted on the holding projections of the bearer members with the holding projections pushed inwards. Elastic covering members have a large number of push-in projections formed at predetermined intervals for fitting into spaces between mutually adjacent panels at positions corresponding to the bearer members or in the vicinity thereof. Since the panels are hard to remove from the outside of a window for prevention of crime, and are removed relatively easily by pushing out the panels from the indoor side for facilitation of escape in emergencies without the need for a special structure for removing the panels from the indoor side.

4 Claims, 7 Drawing Sheets

FACE GRATING

BACKGROUND OF THE INVENTION

1. Field of the Invention

This invention relates generally to a face grating, and more particularly, to a face grating having panels hard to remove from the outside of a window, while being removed relatively easily from the inside of the window.

2. Description of the Prior Art

Most of face gratings in the prior art are of fixed type. On the other hand, there is proposed recently a monolithic aluminum alloy face grating having longitudinal and horizontal main elements fixed to an outer frame. This face grating has anchor fittings on the inside of an outer frame portion for mounting the face grating to a window frame sash by anchoring the fittings to a bearer portion formed on the window frame sash.

The above face grating is hard to remove from the outside and therefore preferable for prevention of crimes, whereas it is removed easily from the inside by unanchoring the above fittings from the bearer portion of the window frame sash in emergencies such as a fire or other disaster.

In spite of the advantages as described above, since the above face grating in the prior art for prevention of crimes and escaping in emergencies is of a monolithic type, and heavyweight as a whole, a complicated mounting is required. Further, since the anchor fittings on the grating side, together with the bearer portions on the window frame sash side, bear the weight of the face grating, the breakage of the face grating occurs easily.

On the other hand, a complicated structure is required for reinforcement of face grating portions anchored to the window frame sash, resulting in an increase in cost.

SUMMARY OF THE INVENTION

An object of the present invention is to provide a more easily mounted, more inexpensive face grating which is effective in prevention of crimes and allows escape in emergencies without the need for a special structure for removal from the inside.

A face grating according to the present invention achieves the above object with a structure comprising: bearer members, which have respectively a large number of holding projections with constricted slot portions at the opposite ends of their base portions and formed at predetermined intervals in a longitudinal direction and projecting toward one side. The bearer members are designed to be fixed substantially horizontally to the upper and lower parts on the outside of a building window or substantially perpendicularly to the left and right sides of the outside of the window with the holding projections facing to the outside of a building in a relatively overlapped arrangement; a large number of elastic panels, which are formed respectively in a substantially channel-like shape, with curved edges of a convex circular sectional shape at the opposing longitudinal sides, and which are put on the holding projections of the bearer members with the holding projections pushed inwards. Elastic covering members are also formed in a substantially U-like sectional shape with a large number of projections formed at predetermined intervals in opposing leg plates. The elastic covering members have substantially circular projections at opposing ends of their top portions which permit the projections to be pushed into spaces between mutually adjacent panels at positions corresponding to the bearer members or in the vicinity of the above-mentioned corresponding positions.

It is preferable that the above bearer members be fixed to a wall face around the window with an appropriate number of fixing elements such as screws or screw spikes. Preferably, these fixing elements are placed at positions corresponding to the panels.

In the above face grating, it is preferable that a panel support member be mounted on the panel face, facing the window, intermediate and parallel to the bearer members. This panel support member may cross the panels at substantially right angles.

BRIEF DESCRIPTION OF THE DRAWINGS

The foregoing and other objects and features of the invention will become apparent from the following description of the preferred embodiments of the invention with reference to the accompanying drawings, in which.

DESCRIPTION OF PREFERRED EMBODIMENTS

Figure 3:
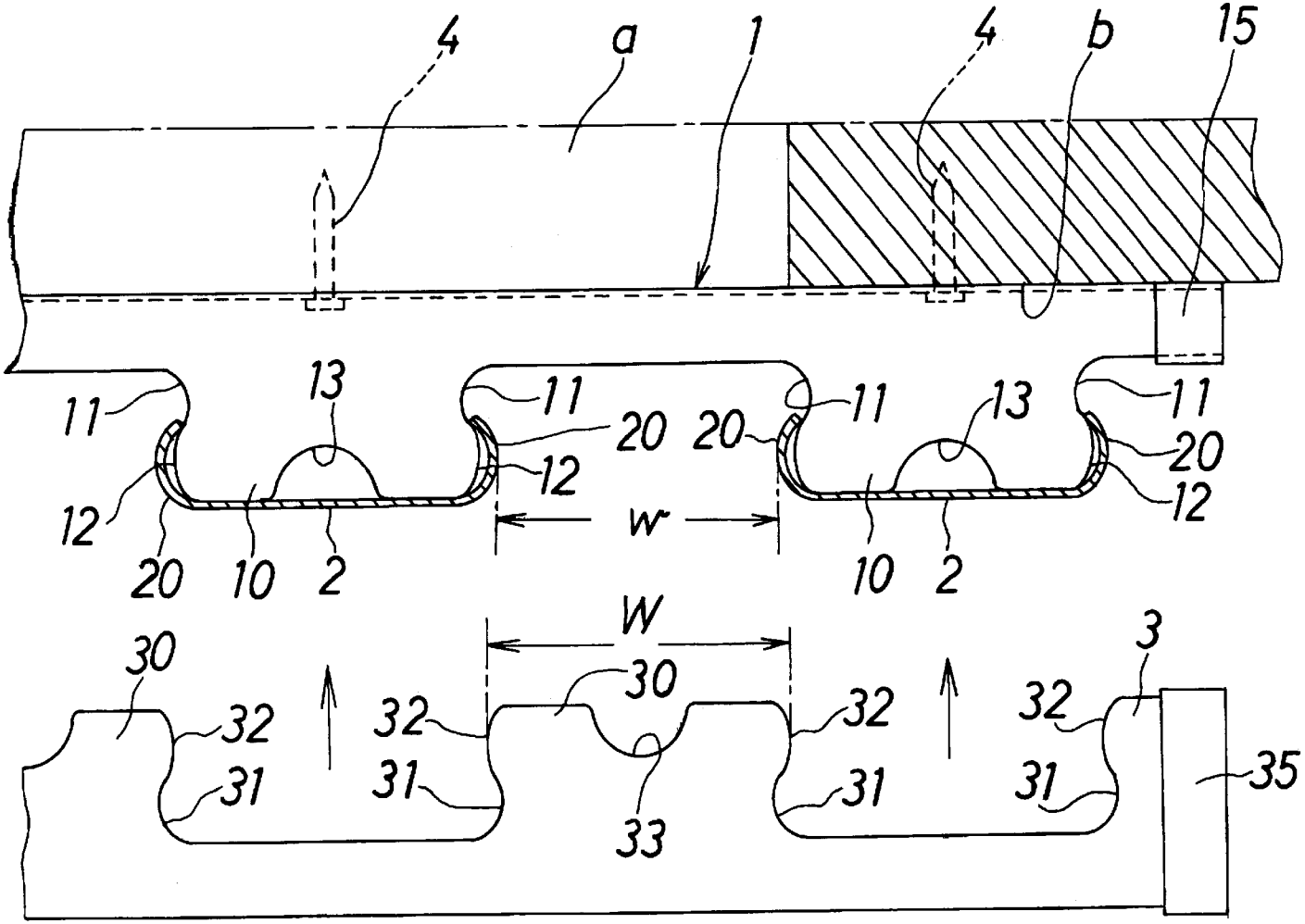
FIG. 3 is a fragmentary exploded sectional view showing the face grating in the state of FIG. 2.
Figure 4:
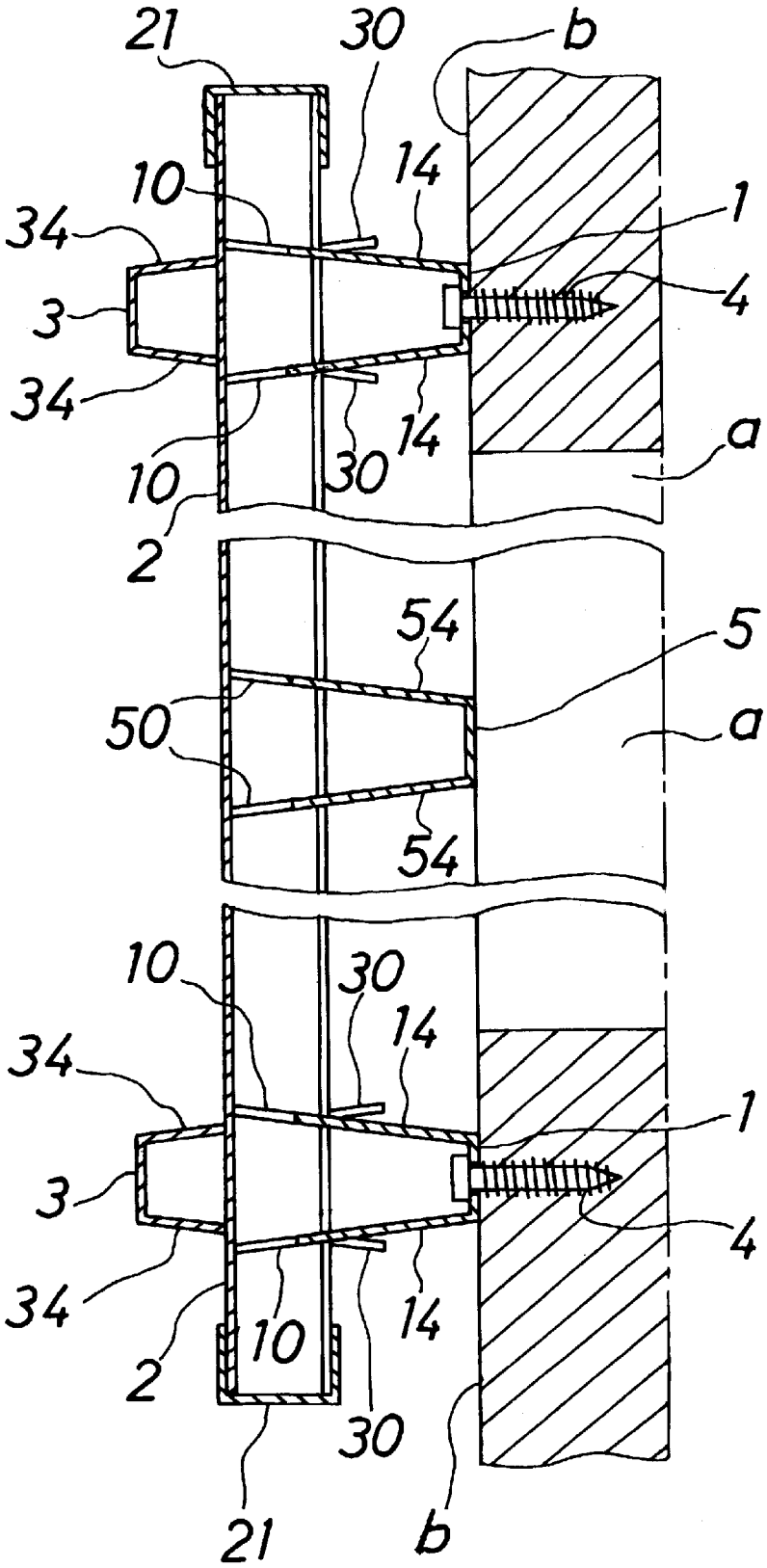
FIG. 4 is a fragmentary enlarged sectional view taken along a line B—B indicated by an arrow in FIG. 1.

In FIGS. 1 to 4, reference numeral 1 denotes a bearer member which is an elastic member of a U-like sectional shape such as an aluminum alloy sheet or a lightweight steel sheet. The bearer member 1 is formed of a metal sheet, which is cut in a predetermined shape with a press and then formed into a substantially U-like sectional shape as shown in FIG. 4.

The opposing leg plates 14, 14 of each bearer member 1 have a large number of substantially uniform-sized holding projections 10 at predetermined intervals in a relatively overlapped arrangement. Each holding projection 10 has convex circular projecting portions 12 at the opposite ends of its top portion and circular constricted slot portions 11 at the opposite ends of its base portion. Each convex circular projecting portion 12 and each concave circular slot portion 11 continuous thereto are shaped like a letter S as a whole.

Each holding projection 10 has a circular notch 13 in the center.

The above bearer members 1, 1 are fixed, in a substantially horizontally parallel arrangement, to the upper and lower parts of a wall face b on the outside of a building window a with the holding projections 10 facing to the outside of the building in a relatively overlapped arrangement.

Each bearer member 1 is fixed to the wall face b around the window a with a plurality of fixing elements 4 such as screws or screw spikes at positions respectively corresponding to the holding projections 10 (that is, locations covered by panels 2 which will be described later). For that reason, the fixing elements 4 are out of sight from the outside of the building.

An adhesive double coated tape having a release paper may be adhered to appropriate positions on each bearer member face facing the wall face b for convenience (temporary fixing and so on) in fixing.

Reference numeral 2 denotes an elastic panel formed in a substantially channel-like shape to have curved portions 20, 20 of a convex circular sectional shape at the opposing sides. Each panel 2 is mounted on a holding projection 10 of each of the bearer members 1, 1 held thereon with the holding projections 10 pushed firmly inwards.

A baked-finish thin aluminum alloy sheet (with a thickness of about 0.6 to 1.0 mm) is used as the material of the panels 2.

Reference numeral 3 denotes an elastic covering member formed in a substantially U-like sectional shape with a large number of substantially uniform-sized push-in projections 30 on the opposing leg plates 34, 34 at predetermined intervals. Each push-in projection 30 has convex circular projecting portions 32 at the opposite ends of its top portion. Each covering member 3 is formed of an aluminum alloy sheet, which is cut in a predetermined shape and then formed into a U-like sectional shape.

Each covering member 3 is installed to cover its corresponding bearer member 1 through the panels 2, and each push-in projection 30 is pushed into a space between the adjacent panels 2 and firmly held therein. That is, the width W of each push-in projection 30 is set to be slightly larger than an interval w between the adjacent panels 2, 2 held by the holding projections 10, as shown in FIG. 3.

Also, the covering members 3 function to press the panels 2 against the holding projections 10 at positions between the mutually adjacent push-in projections 30, 30.

Each illustrated covering member 3 is produced in similar shape and size to each bearer member 1 for mating with a bearer member 1. Thus, each of the push-in projections 30 on the opposing leg plates 34, 34 of each covering member 3 has circular constricted slot portions 31 at the opposite ends of its base. Each projecting portion 12 and each concave circular slot portion 11 continuous thereto are shaped like a letter S as a whole, and the push-in projections 30 at the leg plates 34, 34 are in a relatively overlapped arrangement.

Each push-in projection 30 has a circular notch 33 in the center.

Figure 1:
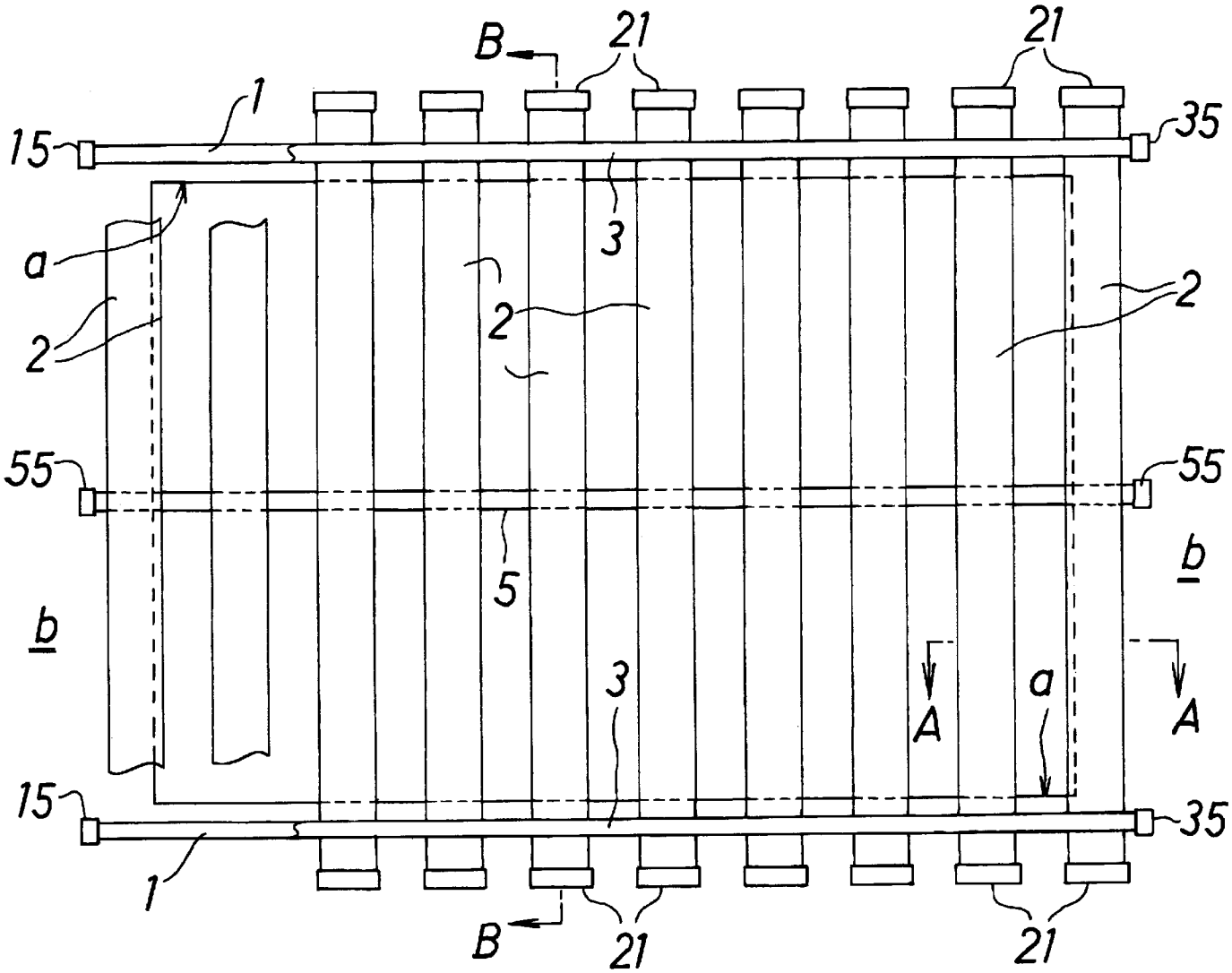
FIG. 1 is a fragmentary broken-away front view showing the state of a face grating in the first embodiment according to the present invention mounted to a window of a building.
Figure 2:
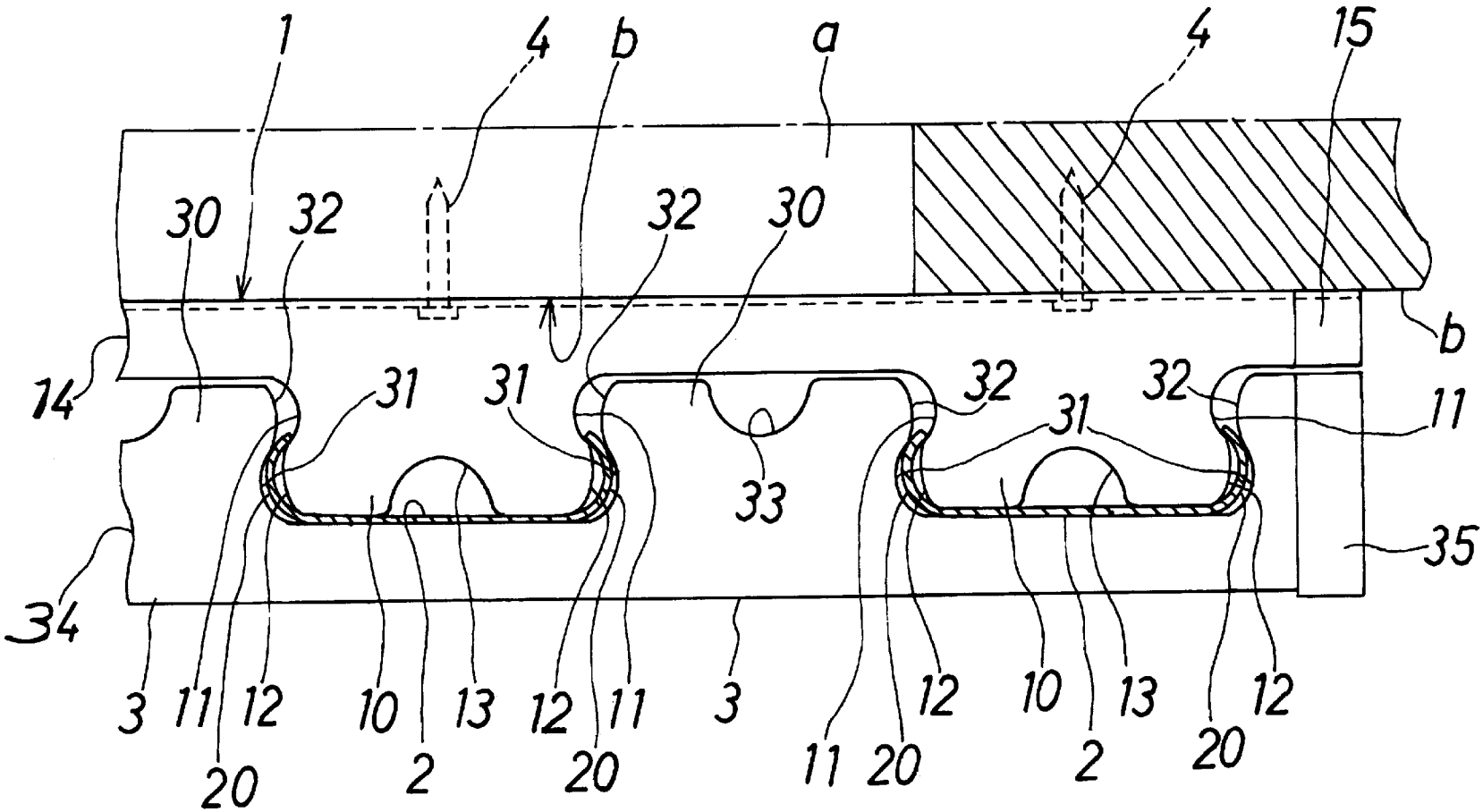
FIG. 2 is an enlarged sectional view taken along a line A—A indicated by an arrow in FIG. 1.

As shown in FIGS. 1 and 4, a panel support member 5 having a smooth portion facing the window a is mounted by a press fit to the longitudinal center of each panel 2, between the panels 2 and the window a.

In the first embodiment, the panel support member 5 is mounted in a monolithically continuous arrangement for reinforcement of the face grating and is similar in material and size to the bearer members 1. Thus, the opposing leg plates 54, 54 have projections 50 similar in shape to the holding projections 10, and the panels 2 are press fit on the projections 50.

The ends of the bearer members 1, the panels 2, the covering members 3 and the member 5 are respectively covered with synthetic resin caps 21, 15, 35 and 55.

The assemblage and mounting of the face grating according to the above first embodiment are as follows. First, the bearer members 1,1 are fixed horizontally above and below the outside of the window. The opposite ends of the panel support member 5 are temporarily fixed to positions close to the center of panels 2 with an appropriate means (such as the adhesive double coated tape, for instance). Subsequently, each panel 2 is fitted to the corresponding holding projections 10 of the upper and lower bearer members 1, 1 and to the projections 50 of the panel support member 5 as shown in FIG. 3. Thereafter, the push-in projections 30 of the covering members 3, 3 are pushed into spaces between the mutually adjacent panels 2, 2 so as to overlap the bearer members 1, 1, resulting in a completion of assemblage and mounting.

It should be understood that each panel 2 might be mounted on the panel support member 5 preliminary to fitting the upper and lower ends of each panel 2 on the holding projections 10 of the bearer members 1 all together, instead of the process of first fixing the panel support member 5 temporarily as described above.

Shielding of sight through the face grating may be set at will by selectively determining the width of each panel 2 and the interval between the panels 2 (i.e., the interval between the holding projections 10 of each bearer member 1) as desired.

When the panels 2 are mounted on the holding projections 10 of the bearer members 1, 1, the channel opening of each elastic panel 2 is widened. Thus, mounting of each panel 2 on the holding projections 10 results in a state wherein the curved portions 20, 20 of each panel 2 elastically grip the holding projections 10.

For a given elasticity of panel 2, the holding force of each panel 2 on the holding projections 10 is determined on the basis of a difference between the size (the width) of each panel 2 and the width (the distance between projecting portions 12) of each holding projection 10 (the latter width is larger).

When the push-in projections 30 of the covering members 3 are pushed into the spaces between the mutually adjacent panels 2, 2, the projections 30 of the covering members 3 deform (bend) by a predetermined amount toward the opening between the opposing leg plates 34, 34.

The deformed push-in projections partially restore elastically upon being fully seated between adjacent panels 2,2. Thus, the panels 2, 2, are pressed firmly against the ends of the opposite holding projections 10, 10 by the projections 30 of the covering members 3.

On the other hand, the elasticity for restoration of the curved portions 20 of the panels 2 constantly presses the portions 20 against the projections 30.

Since the panels 2 are held firmly by the bearer members 1 and the covering members 3 as described above, it is not possible to remove the panels 2 of the grating easily from the outside of an inconveniently situated window.

Further, the fixing elements 4 such as the screws or screw spikes are fixed at positions covered by the panels 2 (i.e., the back of the panels 2 as seen from the outside of the window a). In this manner, the fixing elements are shielded by the panels and thus out of sight from the outside and can not be removed from the outside unless the covering members 3 and the panels 2 are removed. Thus, it is not possible to remove the face grating by removing the fixing elements 4 from the outside.

On the other hand, a strong kick to the center (i.e., the longitudinal center) or central portions of the panels 2 from the inside of the window a or striking the central portions with an implement readily at hand bends the panels 2 outwards. Simultaneously with the deformation of the panels, the upper and lower panel ends held by the bearer members 1 and the covering members 3 slip out of the bearer members 1 and the covering members 3, and therefore fall to the outside. Thus, the panels 2 may be removed from the inside of the window relatively easily.

As is obvious from the above description, the panels 2, the main component of the face grating, are difficult to remove from the outside for prevention of crime, whereas they are removable from the inside of the window relatively easily for convenience in escaping in emergencies.

Also, since the panel support assisting member 5 is fixed to the panels facing the window a, the panels 2 may be removed smoothly all together by pushing-out on the panel portions corresponding to the panel support member 5.

On the other hand, there is provided no space permitting the panels 2 to be bent fully on the inside. Thus, there is no fear that the panels 2 can be detached from the bearer members 1 and the covering member 3 slip out by a strong push against the longitudinal center of the panels 2 from the outside.

The above face grating offers extremely simple mounting and requires no special skills for mounting and assembling.

Figure 5:
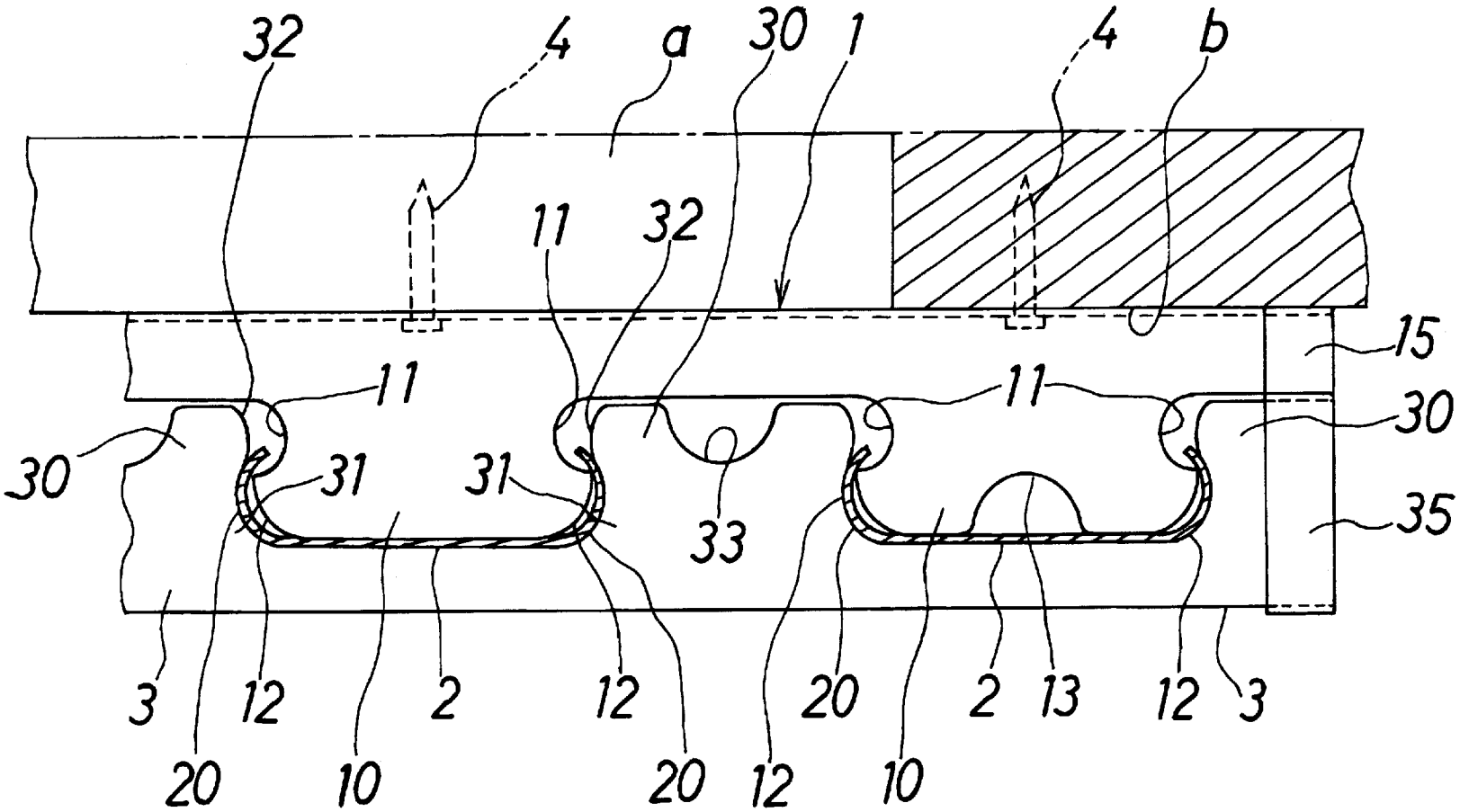
FIG. 5 is a fragmentary sectional view showing a face grating in the second embodiment according to the present invention.

A face grating of a second embodiment, as shown in FIG. 5, is slightly different from the above face grating in structure of bearer members 1 and the covering members 30. That is, each base end portion (i.e., the portion adjoining the constricted slot 11) of the convex circular projections 12 at the opposite ends of each holding projection 10 in the bearer members 1 is formed in an acute-angled shape. The covering members 3 are substantially similar in structure to those in the first embodiment.

According to the face grating in the second embodiment, since each base end portion of the projection 12 of the holding projections 10 in the bearer members 1 is formed in an acuteangle shape, the panels 2 may be held by the holding projections 10 more firmly.

Since the other structures, functions and effects of the face grating in the second embodiment are substantially similar to those of the face grating in the first embodiment, their description will be omitted.

Figure 6:
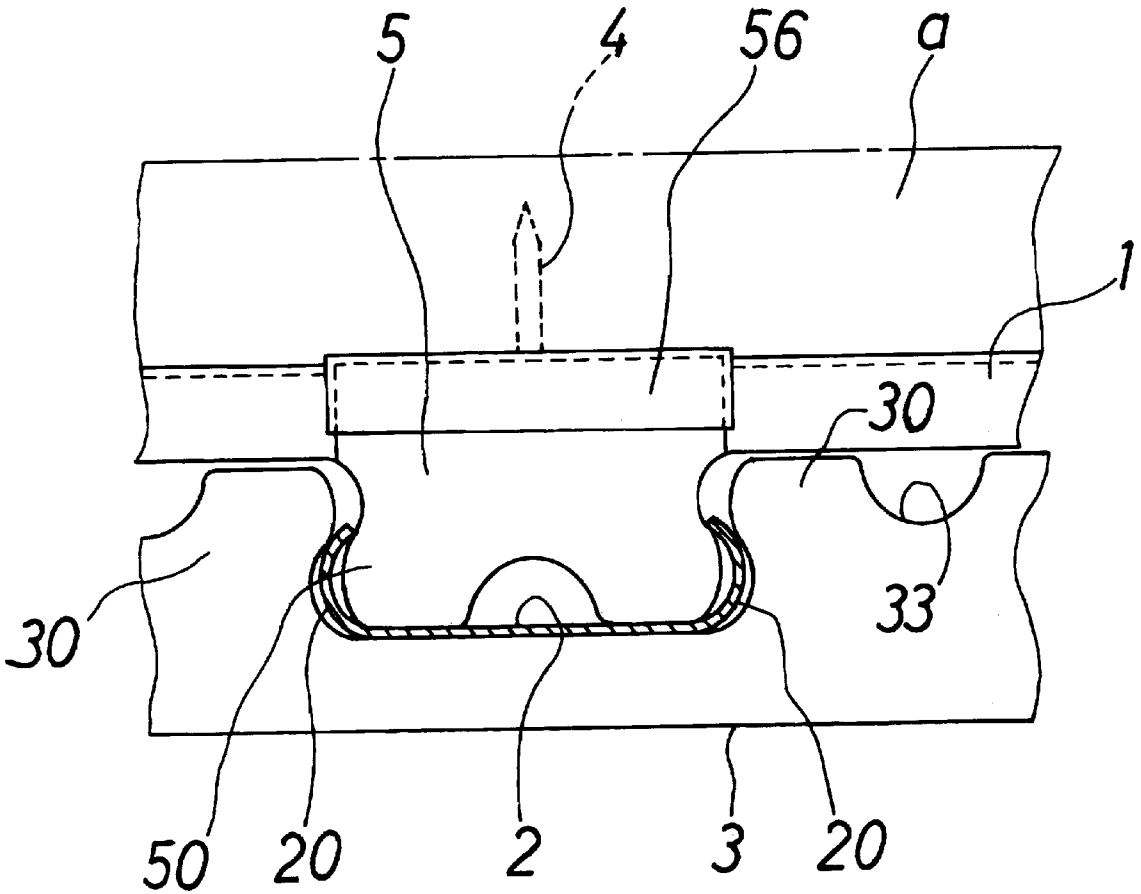
FIG. 6 is a fragmentary sectional view showing a face grating in the third embodiment according to the present invention.

A face grating in the third embodiment shown in FIG. 6 has panel support members 5 mounted on each panel independently, as contrasted with the monolithic continuous structure of member 5 in the first embodiment, and a portion facing the window a is covered with a cap 56 made of a synthetic resin or the like. Thus, the panel support members 5 need to be mounted to the panels 2 in advance before fitting the panels 2 to the bearer members 1.

Since the third embodiment allows removal of the panels 2 separately, less force is required for pushing out the panels 2 from the inside for removal.

The other structures, functions and effects of the face grating in the third embodiment are substantially similar to those of the face grating in the first embodiment, and hence, their description will be omitted.

Figure 7:
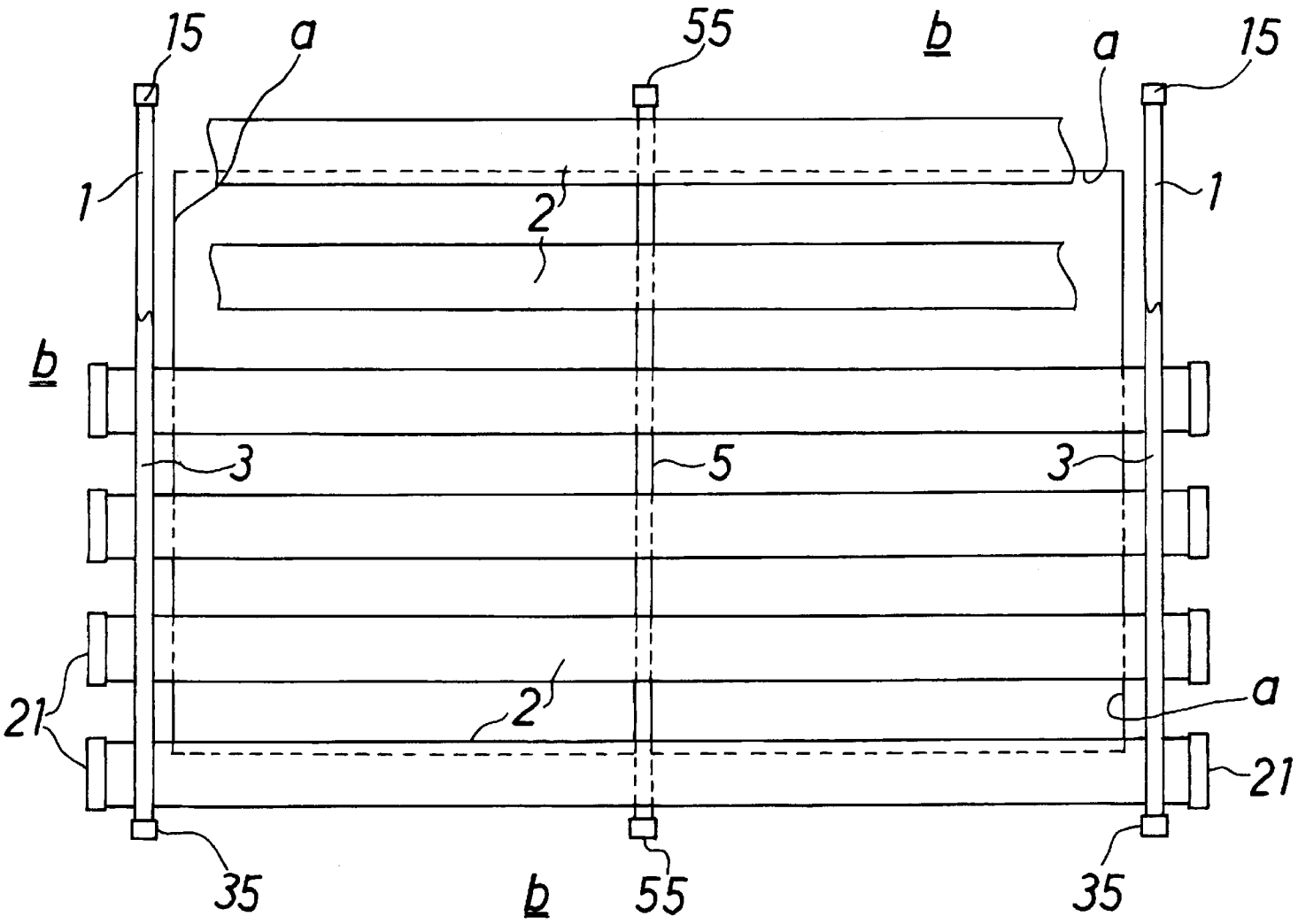
FIG. 7 is a fragmentary broken-away front view showing a face grating in the fourth embodiment according to the present invention.

According to a face grating in the fourth embodiment shown in FIG. 7, the bearer members 1 are oriented vertically and fixed to the opposite sides of a square window a. The panels 2 are mounted to the bearer members 1 horizontally, and the covering members 3 are mounted to positions corresponding to the bearer members 1.

A panel support member 5 similar in structure to bearer members 1 is mounted to the longitudinal center of the panels 2, crossing at right angles with the panels 2.

The other structures, functions and effects of the face grating in the fourth embodiment are substantially similar to those of the face grating in the first embodiment, and hence, their description will be omitted.

A polycarbonate or other plastic molded sheet or like material having elasticity may be used for the panels 2, instead of the above-mentioned aluminum alloy sheet. Further, any panels formed in a substantially channel-like shape as a whole, with curved portions 20, 20 at the opposite edges, will serve as panels 2. Thus, for reinforcement and fine appearance, longitudinal small grooves may be formed in a portion other than the curved portions 20 and, moreover, the panels may be painted any appropriate color.

A plastic molded product of a shape fitting into the panels 2 may be used for the panel support member 5, instead of the above metal sheet.

There is no need for the number of fixing elements 4 to be as many as the panels 2 for fixing each bearer member 1 to the wall face b around the window a. If each fixing element 4 is sufficiently strong, a number of fixing elements 4 smaller than the number of panels 2 will do for fixing each bearer member 1 to the wall face b.

The face grating according to the present invention offers the following advantages. Firstly, the face grating of the present invention is hard to remove from the outside of the building, as described above, for prevention of crime, whereas it is removed relatively easily from the indoor side by pushing the panels outwards. Thus, this face grating is also convenient in escaping in emergencies without the need for special means for removing the panels from the indoor side.

Secondly, the face grating of the present invention offers extremely simple mounting and requires no special skills for mounting and assembling.

Thirdly, the fixing elements 4 such as the screws or screw spikes are fixed at positions corresponding to the panels 2 and are thus shielded by the panels 2 from sight. For that reason, it is not possible to remove the fixing elements from the outside. Thus, the face grating of the present invention is well suited for prevention of crime.

Fourthly, since the panel support member 5 is mounted on the panel face facing the window a, the panels 2 may be removed more smoothly in escaping by application of force to the panel portions corresponding to the panel support member 5.

Fifthly, when the panel support member 5 is in a monolithic continuous structure, not only does it provide reinforcement of the face grating, it also allows removal of the panels 2 from the inside all together.

What is claimed is:

1. A face grating, comprising:

bearer members, each of said bearer members having holding projections formed at predetermined intervals along a longitudinal dimension and being adapted to be fixed to the outside wall of a building, above and below or to the left and right of a window, with said holding projections facing outward from the building in a relatively overlapped arrangement, each of said holding projections having a base portion with slots cut out of opposite ends;

a plurality of substantially channel-shaped elastic panels, having curved portions of a convex circular sectional shape at opposing longitudinal edges, which elastically clip onto said holding projections of said bearer members; and elastic covering members, each of said covering members having a substantially U-shape cross-section defined by a pair of opposing leg plates and a plurality of push-in projections formed on the opposing leg plates at predetermined intervals, each of said push-in projections having a top portion with opposing ends of a substantially circular shape, said covering members being locked to said panels by engagement of said push-in projections in spaces between mutually adjacent panels, at positions corresponding to or in the vicinity of said bearer members.

2. A face grating according to claim 1, wherein said bearer members are fixed to a wall face around the window with an appropriate number of fixing elements such as screws or screw spikes, and said fixing elements are placed at locations corresponding to the panels.

3. A face grating according to claim 1, further comprising a panel support member spanning said panels intermediate said bearer members.

4. A face grating according to claim 3, wherein said panel support member is a single monolithic member mounted crossing said panels at substantially right angles.

* * * * *